US007107919B2

(12) United States Patent
Hasegawa

(10) Patent No.: US 7,107,919 B2
(45) Date of Patent: Sep. 19, 2006

(54) UPPER DECORATIVE STITCHING DEVICE

(75) Inventor: Shogo Hasegawa, Higashiosaka (JP)

(73) Assignee: Hosei Mishin Seizo Kabushiki Kaisha, Osaka-fu (JP)

( * ) Notice: Subject to any disclaimer, the term of this patent is extended or adjusted under 35 U.S.C. 154(b) by 0 days.

(21) Appl. No.: 11/261,666

(22) Filed: Oct. 31, 2005

(65) Prior Publication Data

US 2006/0107885 A1 May 25, 2006

(30) Foreign Application Priority Data

Nov. 16, 2004 (JP) ..... 2004-331482

(51) Int. Cl.
*D05B 3/12* (2006.01)
*D05B 69/02* (2006.01)

(52) U.S. Cl. ..... 112/100; 112/284

(58) Field of Classification Search ..... 112/302, 112/187, 284, 162, 286, 100
See application file for complete search history.

(56) References Cited

U.S. PATENT DOCUMENTS 1,405,855 A * 2/1922 Moffatt ..... 112/100
1,855,254 A * 4/1932 Moffatt ..... 112/100
3,776,157 A * 12/1973 Szostak ..... 112/162
5,383,414 A * 1/1995 Winter et al. ..... 112/162
5,901,655 A * 5/1999 Sadasue ..... 112/162

FOREIGN PATENT DOCUMENTS

JP 10-137474 5/1998

* cited by examiner

*Primary Examiner*—Ismael Izaguirre
(74) *Attorney, Agent, or Firm*—Wenderoth, Lind & Ponack, L.L.P.

(57) ABSTRACT

An upper decorative stitching device is designed to make it possible to precisely transmit the swing movement of a first lever which is capable of swing movements widthwise in a pendulum manner to horizontal reciprocating motion of a second lever, which is provided with a spreader. The device facilitates the operation of switching between an upper decorative stitching and no upper decorative stitching. A connecting rod (9) is provided at both ends with spherical bearings (10, 11) to provide a connection between the first lever (3) and the second lever (8), thereby converting the rotation of the upper shaft into the reciprocal movement of the spreader.

7 Claims, 3 Drawing Sheets

UPPER DECORATIVE STITCHING DEVICE

BACKGROUND OF THE INVENTION

The present invention relates to an upper decorative stitching device to be provided mainly on a flat seam stitching machine. Its object is to make it possible to convey precisely the swing movements of the first lever which shows swing movements widthwise in a pendulum style to the horizontal reciprocating motion of the second lever provided with a spreader, to make it possible to reduce the cost of the device by simplifying the structure of the upper decorative stitching device, and also to facilitate the switching operation between the case of the upper decorative stitching and the case of the flat seam stitching.

As an upper decorative stitching device having a first lever which shows swing movements widthwise in a pendulum style in front of the sewing machine by a swing width cam provided on an upper shaft and a second lever having a spreader at the front end which also reciprocates horizontally with the other end of the connecting rod connected to the lower end of the first lever, there is known for example a patent document by the present applicant, i.e. Japanese Patent Publication Number 10-137474. As the upper decorative stitching device is made to connect the spot between the first lever which shows swing movements widthwise in a pendulum style in front of the sewing machine and the second lever which reciprocates horizontally along the needle position with a plate form connecting rod, there were movements up and down caused by the connecting rod at one end and the other end of the swinging step of the first lever, thereby making it difficult to reflect the swing motion of the first lever accurately on the movements of the second lever which should reciprocate horizontally. Moreover, as the upper decorative stitching device is made to change the stitching mode between the upper decorative stitching and the other stitching, e.g., flat seam stitching, by the switching operation of the clutch provided between the upper shaft and the swing width cam, machine construction is complicated which results in elevation of cost.

It is therefore an object of the present invention to provide an upper decorative stitching device capable of precisely conveying the swing movements of the first lever which shows swing movements widthwise in pendulum style to the horizontal reciprocating motion of the second lever, thereby simplifying the structure to obtain cost reduction, and also to make the switching operation between the upper decorative stitching and the flat seam stitching easier.

SUMMARY OF THE INVENTION

To solve the object as described above, the present invention provides an upper decorative stitching device designed to convert the rotation of the upper shaft into the reciprocal movements of the spreader by connecting the spot between the first lever which shows swing movements widthwise in a pendulum style in front of the sewing machine and the second lever which reciprocates horizontally along the needle position with a connecting rod having spherical bearings at both ends by bringing a follower into contact with the swing width cam provided on the upper shaft.

The second feature of the invention is to provide an upper decorative stitching device having a simple structure which permits easier changeover of the stitching mode between the upper decorative stitching and the other mode, e.g., flat seam stitching, by making it possible for a thread guide supporting member having at the lower end a thread guide for feeding upper decorative thread to the spreader to be switched over between the thread feeding position and the non-feeding position.

The third feature of the invention is that the thread guide supporting member is fixed to the front end of the mounting shaft whose front and rear ends are borne by the frame having a second lever, and is forced by coil springs whose front and rear ends are borne by the thread guide cam and the bearings, and, mediated by engagement between a plurality of the recesses and projections disposed on the opposed surfaces of the thread guide cam and the frame, in an ordinary time the thread guide supporting member shall be held perpendicularly to the thread feeding position, and when no upper decorative stitching thread is fed it shall be obviated nearly horizontally to the front right side of the sewing machine and held in a non-feeding position, then engaging the thread guide supporting member displaced to the non-feeding position with the first lever by way of engagement between the recesses and the projections, and separating the first lever from the swing width cam by engaging the thread guide supporting member displaced to the non-feeding position with the first lever to stop the operation of the spreader, thereby expecting to make the changeover operation more rapid and to obtain stability at the changeover position.

The upper decorative stitching device of the present invention is constituted so that the rotation of the upper shaft is precisely converted into the reciprocal movements of the spreader by means of a connecting rod having spherical bearings at both ends between a first lever which shows swing movements widthwise in front of the sewing machine by bringing a follower into contact with a swing width cam provided on an upper shaft and a second lever provided at its front end with a spreader which horizontally reciprocates along the needle position.

A thread guide supporting member having at its lower end a thread guide for feeding an upper decorative stitching thread to a spreader is provided so as to make it possible to be switched over between the thread feeding position and the non-feeding position.

A thread guide supporting member is fixed to the front end of the mounting shaft whose front and rear ends are borne by the frame having the second lever, and is forced by coil springs whose front and rear ends are borne by the thread guide cam and the bearings, and, mediated by engagement between the recess and the projection disposed on the opposed surfaces of the thread guide cam and the frame, in ordinary time the thread guide supporting member shall be held perpendicularly to the thread feeding position, and when upper decorative stitching thread is not fed it shall be obviated nearly horizontally to the front right side of the sewing machine and held in a non-feeding position, and then the thread guide supporting member displaced to the non-feeding position is engaged with the first lever, and the first lever is separated from the swing width cam to stop the operation of the spreader.

DETAILED DESCRIPTION OF THE INVENTION

Next, explanation will be given of embodiments of the present invention in accordance with the accompanying drawings.

Figure 1:
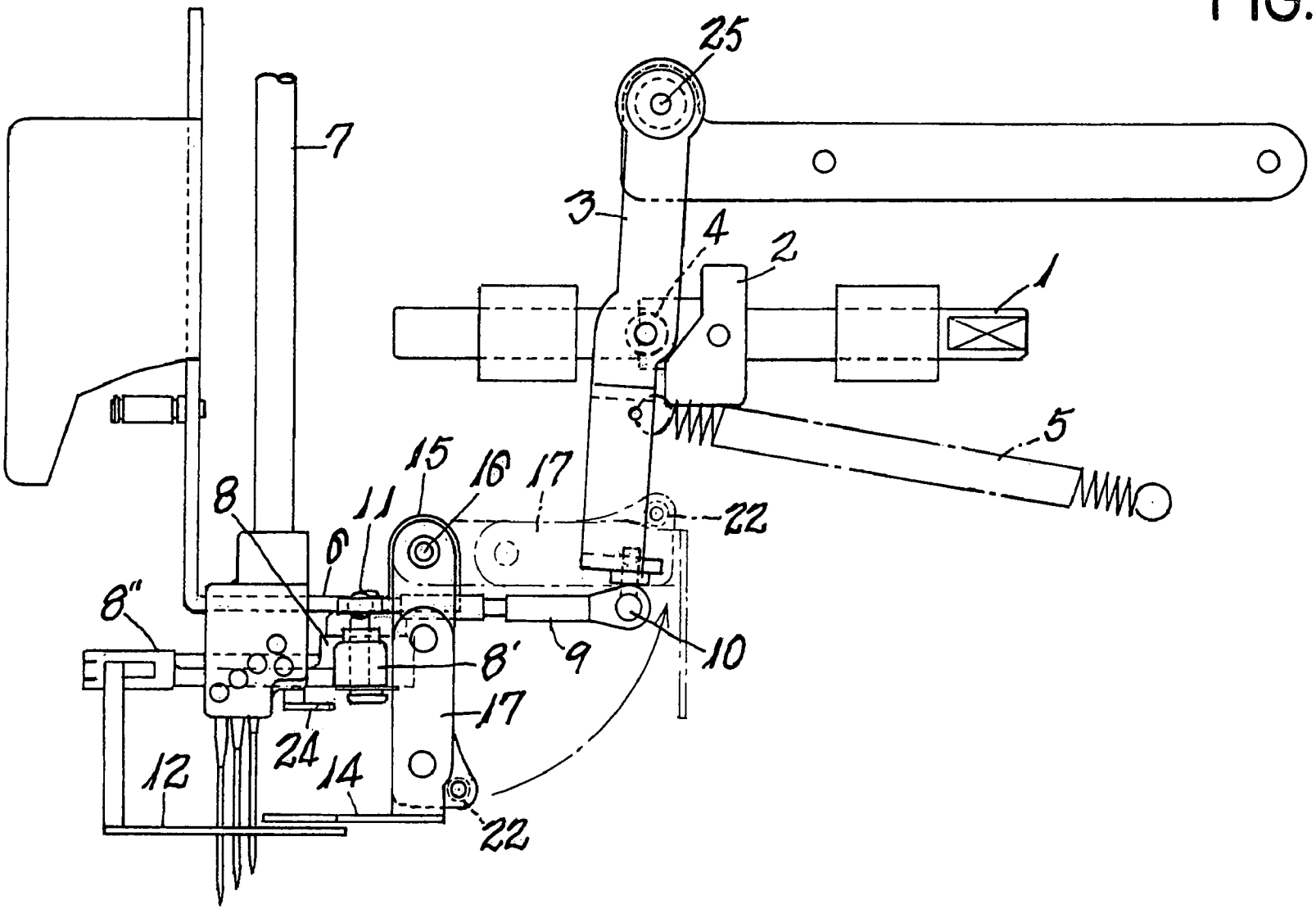
FIG. 1 is a partial cutaway front view of the upper decorative stitching device according to the present invention.
Figure 2:
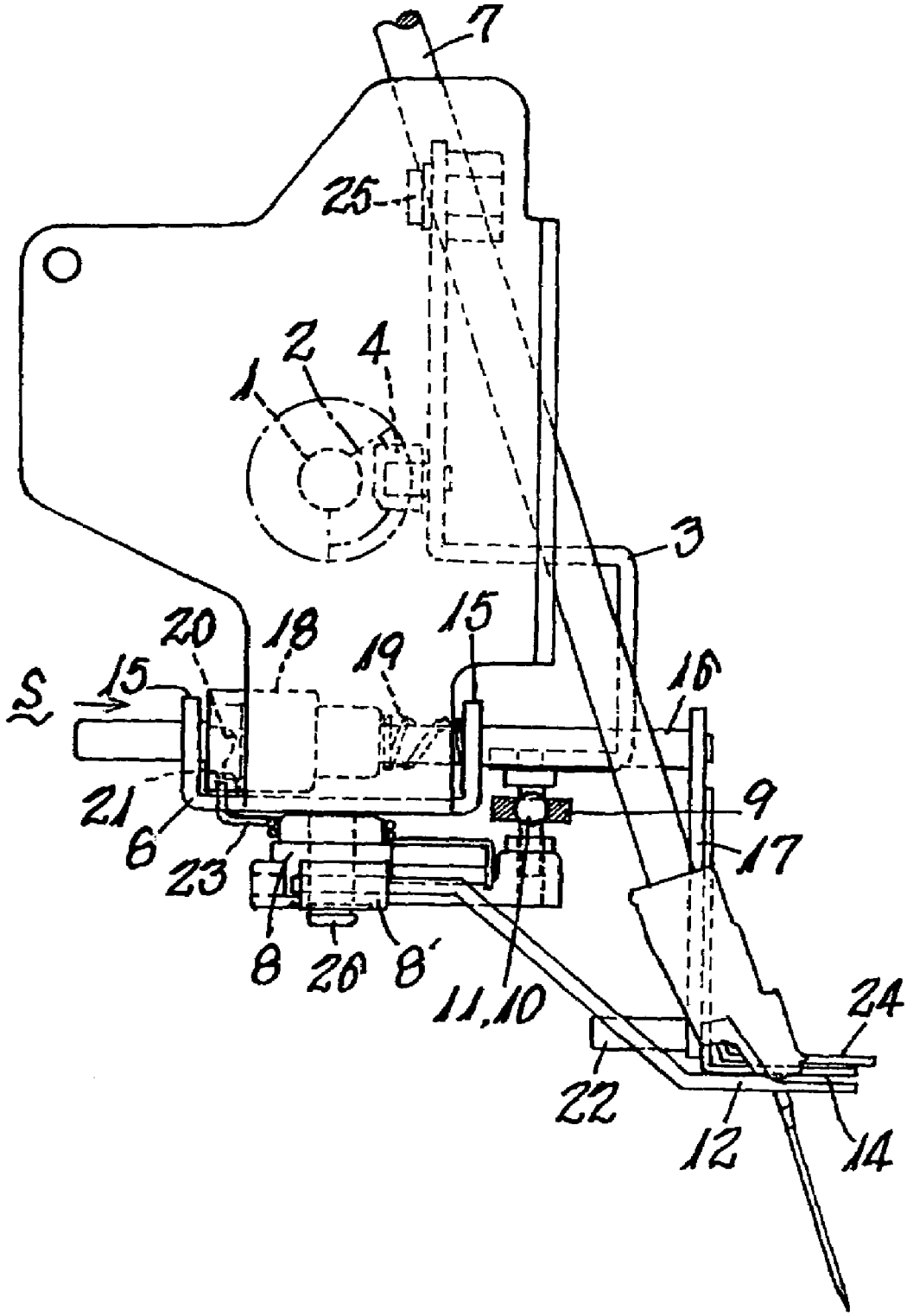
FIG. 2 is a partial cutaway side view of the device.
Figure 3:
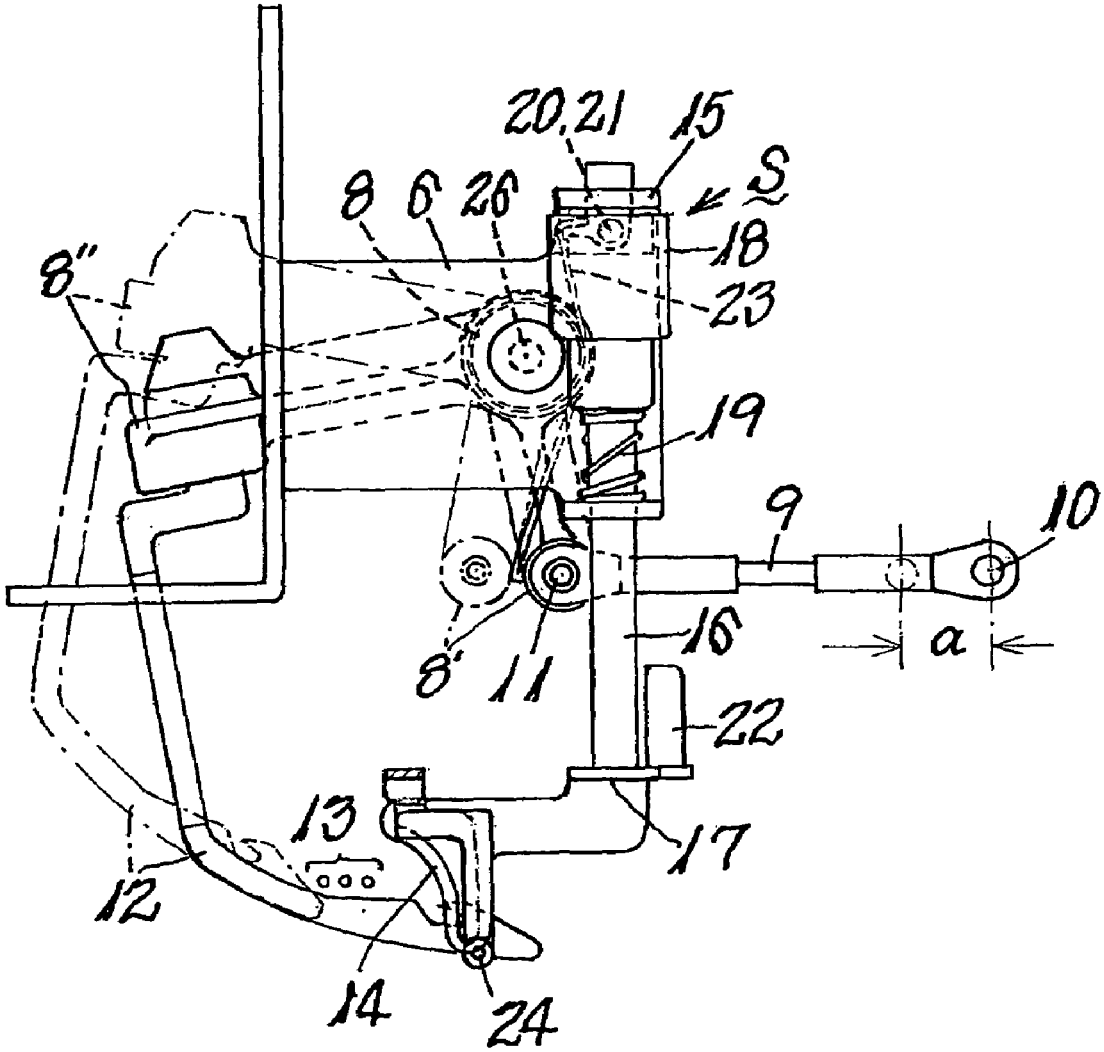
FIG. 3 is a partial cutaway plan view showing mainly the driving portion of the spreader.

FIG. 1 is a partial cutaway front view of the upper decorative stitching device according to the present invention, FIG. 2 is a partial cutaway side view of the device, and FIG. 3 is a partial cutaway plan view showing mainly the driving portion of the spreader.

In the drawings showing the embodiments, reference numeral 1 designates an upper shaft which repeats reciprocal semi-rotation along with the driving of the sewing machine, a swing width cam 2 is fixed to the upper shaft 1, a first lever 3 which moves in a swinging motion widthwise in front of the sewing machine along with the rotation of the upper shaft 1, a frame 6 is formed on the right side in the illustration rearward of the elevating position of the needle bar 7, a bell crank type second lever 8, borne on the reverse surface of the frame 6, is provided in a freely swinging manner in a horizontal direction, and a connecting rod 9 is a means of connecting the lower end part 3' of the first lever 3 with the one side arm 8' of the second lever 8 to convert the swinging movement of the first lever 3 into the horizontal reciprocal movement.

The connecting rod 9 connects the lower end part 3' of the first lever 3 with the one side arm 81 of the second lever 8 mediated by the spherical bearings 10, 11 provided at both ends, by which it converts the swinging movements of the lower end part 31 of the first lever 3 into the horizontal reciprocal movement of the second lever 8 as precisely as possible. The reference mark (a) in FIG. 3 denotes a stroke of the connecting rod 9.

The reference numeral 12 denotes a spreader provided with its base end part fixed to the front end of the other arm 8" (left-hand in the figure) of the second lever 8. The spreader 12 is angled downwardly as shown in FIG. 2, so as to reciprocate along the outside of the needle position 13 as shown in FIG. 3.

A thread guide 14 provided at the right side in front of the needle position 13, is provided at the lower end of the thread guide supporting member 17 which is fixed to the front end of the mounting shaft 16 whose front and rear parts are borne by the bearing 15 which is erected on the frame 6, and, biased by a coil type spring 19 which is set between the thread guide cam 18 fixed to the mounting shaft 16 and the operator side bearing 15, it is placed at an ordinary time in a feeding position of upper decorative thread (solid line position in illustration).

On the confronting surfaces between the rear end part of the thread guide cam 18 (left side in FIG. 2) and the frame 6, there are provided a recess 20 which continues for about 90 degrees along the rotation direction on the thread guide cam 18 side and a projection 21 provided on the frame 6 in a position corresponding to the recess 20, and, by engagement between the recess 20 and the projection 21, the thread guide supporting member 17 is held in a perpendicular state at an end of the recess 20 in order to hold the thread guide 14 in a feeding position of the upper decorative thread.

In the case of the flat stitch and the over-lock stitch in which no upper decorative stitch thread is fed, when a rotary operation is made by 90 degrees in the arrow marked direction in FIG. 1 with a switching operation knob 22 provided on the lateral side of the thread guide supporting member 17, the projection 21 on the frame 6 side is engaged with the other end of the recess 20 on the thread guide cam 18 side to hold the thread guide 14 in the obviating position shown by the dashed line in the same figure.

Both side ends of the recess 20 are formed optionally in a deeper style, so that they can be engaged by the projection to stop in a manner of click motion. Needless to say, engagement and release between the recess 20 and the projection 21 are elastically performed against the bines of the spring 19 which forces the thread guide cam 18 and the thread guide supporting member 17 on the mounting shaft 16.

As will be clear from the foregoing description, in this embodiment the switching means S of the thread guide 14 comprise the recess 20 on the thread guide cam 18 side, the projection 21 on the frame 6 side, the switching operation knob 22 on the lateral side of the thread guide supporting member 17, and the spring 19 for biasing the thread guide cam 18.

The thread guide supporting member 17 displaced to the obviating position in the manner as stated above causes the lateral side switching operation knob 22 to come into pressure contact with the lateral side of the first lever 3, as shown in the dashed lines in FIG. 1. By this pressure contact of the switching operation knob 22, the first lever 3 is displaced beyond the range of swing motion to separate the engagement between the follower 4 and the swing width cam 2 as shown in FIG. 1, whereby the connecting rod 9 and the second lever 8 are stopped from operating and driving of the spreader 12 is stopped.

Furthermore, when the thread guide supporting member 17 is reinstated to the position illustrated in solid line by operating the switching operation knob 22, the follower 4 comes into contact with the swing width cam 2 by traction of the spring 5 to reinstate the device simply to the upper decorative stitching state.

In the drawings, the element indicated by the numeral 23 denotes a return spring of the second lever 8, 24 denotes a thread guide, 25 denotes a fulcrum shaft of the first lever 3 positioned at the front upper part of the sewing machine, and 26 denotes a fulcrum shaft of the second lever 8.

The upper decorative stitching device according to the present invention is highly useful in the case of partly changing over the sewing method in the course of sewing a piece of garment such as for example for upper decorative stitching a neck portion or a sleeve of a pajama, and flat stitching or over-lock stitching a bottom portion.

Needless to say, the fixing positions, respective sizes, etc. of the first lever, second lever, connecting rod for connecting the two levers and the spreader are not limited to the style of the disclosed embodiment but their designs may be optionally modified in line with the purport of the present invention.

DESCRIPTION OF THE NUMERALS USED

1 Upper shaft
2 Swing with cam
3 First lever (3' denotes the lower end part)
4 Follower
5 Spring
6 Frame
7 Needle bar
8 Second lever (8' depicts a one-side arm and 8" the other side arm)
9 Connecting rod ('a' denotes a stroke of the connecting rod)
10 Spherical bearing
11 Spherical bearing
12 Spreader

13 Needle position
14 Thread guide
15 Bearing
16 Mounting shaft
17 Thread guide supporting member
18 Thread guide cam
19 Spring
20 Recess
21 Projection
22 Knob for switching operation
S Switching means
23 Return spring for second lever
24 Thread guide
25 Fulcrum shaft for first lever
26 Fulcrum shaft for second lever

What is claimed is:

1. An upper decorative stitching device for a sewing machine, the device comprising:

a swing width cam mounted on an upper shaft;

a first lever capable of swing movements widthwise in front of the sewing machine by direct contact of a follower with the swing width cam provided on the upper shaft;

a second lever having front end;

a spreader which is horizontally reciprocal along a needle position, wherein the spreader is provided at the front end of the second lever; and a connecting rod having spherical bearings at both ends thereof for connecting the first and second levers so as to convert the rotation of the upper shaft into the reciprocal movement of the spreader.

2. The upper decorative stitching device of claim 1, further comprising a thread guide supporting member having at its lower end a thread guide for feeding an upper decorative stitching thread to the spreader, wherein the thread guide supporting member is provided so as to enable it to be switched over between a thread feeding position and a non-feeding position.

3. The upper decorative stitching device of claim 2, further comprising:

a frame having a projection and supporting the second lever:

at least one bearing supported on the frame;

a mounting shaft having front and rear ends that are supported by the frame, wherein the thread guide supporting member is fixed to the front end of the mounting shaft;

a thread guide cam fixed to the mounting shaft and defining a recess for receiving the projection; and a coil spring having front and rear ends borne by the thread guide cam and the bearing, wherein the thread guide supporting member is held in a nearly vertical position in the thread feeding position, and when upper decorative stitching thread is not fed, the thread guide member can be moved to a nearly horizontal position in the non-feeding position, wherein, in the non-feeding position, the thread guide supporting member engages the first lever so as to separate the first lever from the swing width cam to stop operation of the spreader.

4. The upper decorative stitching device of claim 3, wherein the recess continues for approximately 90 degrees in a radial direction in a surface of the thread guide cam.

5. The upper decorative stitching device of claim 4, wherein the recess is formed so that the projection can be held in opposite ends thereof, and the opposite ends correspond to the thread feeding position and the non-feeding position.

6. The upper decorative stitching device of claim 1, wherein the second lever is a bell crank type of lever.

7. The upper decorative stitching device of claim 1, wherein the connecting rod is directly connected to the first and second levers.

* * * * *